US009868576B2

(12) United States Patent
Guo

(10) Patent No.: US 9,868,576 B2
(45) Date of Patent: Jan. 16, 2018

(54) PLASTIC PACKAGE WITH AN OPEN REMINDER

(71) Applicant: Peng-Yi Guo, New Taipei (TW)

(72) Inventor: Peng-Yi Guo, New Taipei (TW)

(73) Assignee: PONI GREENTEK CO., LTD., New Taipei (TW)

( * ) Notice: Subject to any disclaimer, the term of this patent is extended or adjusted under 35 U.S.C. 154(b) by 49 days.

(21) Appl. No.: 15/169,625

(22) Filed: May 31, 2016

(65) Prior Publication Data

US 2017/0341841 A1 Nov. 30, 2017

(51) Int. Cl.
*B65D 17/34* (2006.01)
*B65D 77/32* (2006.01)
*B65D 43/14* (2006.01)

(52) U.S. Cl.
CPC ..... *B65D 77/32* (2013.01); *B65D 43/14* (2013.01); *B65D 2543/00833* (2013.01)

(58) Field of Classification Search
CPC ..... B65D 77/32–77/40; B65D 43/14; B65D 2543/00833; B65D 33/2516; B65D 33/2533; B65D 50/00
USPC .... 220/276, 270, 315, 265, 266, 359.2, 269, 220/784, 788, 309.2, 835, 799, 212, 260, 220/751; 215/48, 201–225
See application file for complete search history.

(56) References Cited

U.S. PATENT DOCUMENTS

| | | | | |
|---|---|---|---|---|
| 8,127,961 | B2 * | 3/2012 | Vovan | B65D 43/0206 220/212 |
| 8,672,166 | B2 * | 3/2014 | Nazareth | B65D 43/0241 215/256 |
| 8,757,416 | B2 * | 6/2014 | Golota | B65D 43/0249 220/266 |
| 2010/0140267 | A1 * | 6/2010 | Sellari | B65D 43/0241 220/270 |
| 2012/0103990 | A1 * | 5/2012 | McCumber | B65D 41/165 220/270 |
| 2014/0027458 | A1 * | 1/2014 | Liu | B65D 43/164 220/270 |
| 2014/0209607 | A1 * | 7/2014 | Fosse | B65D 43/162 220/270 |
| 2015/0028033 | A1 * | 1/2015 | Samuel | B65D 43/0266 220/270 |
| 2016/0023815 | A1 * | 1/2016 | Siskindovich | B65D 43/0254 220/270 |

* cited by examiner

*Primary Examiner* — Kareen Thomas

(57) ABSTRACT

A plastic package with an open reminder comprises a container and cover; the container being mainly composed of the step portion, horizontal extending surface, outer folding portion, and the protruding portion; the cover being mainly composed of the concave portion, horizontal covering body, and tab; the container and the cover being combined into the plastic package, which forms an open reminder with the tab and perforated line, thereby achieving a function of open reminder that is easy to be observed when the cover has been opened.

5 Claims, 11 Drawing Sheets

PLASTIC PACKAGE WITH AN OPEN REMINDER

FIELD OF THE INVENTION

The present invention relates to a plastic package with an open reminder, particularly to a plastic package that can be easy to use and protect contents inside the package, and also can be easily observed if the package has been opened through the open reminder.

BACKGROUND OF THE INVENTION

In the current market, plastic molding packages, such as lunch boxes, fruit boxes, sushi boxes, 3C product packages, are packed with a cable tie, or combined with a paper card for protecting the package from being undesirably opened or easily observed the package whether the lid has been opened.

Also, the cost for package has been relatively increased, so the prior arts have disclosed a variety of packages to decrease the manufacturing cost and protect the contents inside the package.

However, the prior arts still have some problems, for example, the packages are needed to have more space to store, the packages are not easy to open, and the packages lacked of open reminder thereon.

As such, how to solve the above-mentioned problems and provide a plastic package with an open reminder is needed, which not only can save manufacturing cost and storage space, but also can be observed that the cover thereof has been opened.

SUMMARY OF INVENTION

The present invention provides a plastic package with an open reminder that is easy to be observed when the cover has been opened.

For solving the above problems and achieving the purpose of the present invention, the technical scheme of the present invention is to disclose a plastic package with an open reminder, comprising: a container, a cover; the container comprising a containing space therein, a step portion formed around an inner wall thereof, a horizontal extending surface formed around an outer edge of the step portion, an outer folding portion formed around an outer edge of the horizontal extending surface and extending downward therefrom, and a protruding portion formed between the horizontal extending surface and the outer folding portion, the protruding portion being disposed at a position higher than the horizontal extending surface;

the cover comprising a concave portion formed therearound and corresponding to the step portion for securing the cover in place when the cover is sealed, a horizontal covering body extending from an outer edge of the concave portion, contacting to an inner wall of the protruding portion, and covering on the horizontal extending surface; the horizontal covering body having at least a tab sticking out from a corner of the horizontal extending surface; the tab comprising a perforated line and a pulling piece, the perforated line extending from a point near the tab to another point far away therefrom and arranged along an edge of the pulling portion;

when the plastic package is sealed, the container is covered by the cover, and the concave portion is embedded into the step portion for combining together; when opening the cover, holding and pulling up the tab is needed to tear off the pulling piece along the perforated line, followed by horizontal covering body, thereby opening the cover.

More preferably, wherein the protruding portion is formed with a first gap corresponding to the tab.

More preferably, wherein the horizontal covering body is formed with a connecting surface disposed at one side thereof to connect with a corresponding side of the horizontal extending surface.

More preferably, wherein the protruding portion is formed with a second gap corresponding to the connecting surface.

More preferably, wherein the horizontal extending surface is formed with a recess corresponding to the tab for fixing the tab when the cover is closed.

Compared to prior arts, the present invention has the following advantages:

when the plastic package is sealed, the container is covered by the cover, and the concave portion is embedded into the step portion (11) for combining together; when opening the cover, holding and pulling up the tab is needed to tear off the pulling piece along the perforated line, followed by horizontal covering body, thereby achieving a function of open reminder that is easy to be observed when the cover has been opened.

Besides, due to positions between the protruding portion and the horizontal covering body that the protruding portion is disposed at a position higher than the horizontal covering body, it is not easy to open the cover through the horizontal extending surface and the horizontal covering body, the only way to open the cover is to tear off the perforated line, thus it is very easy to observe whether the plastic package has been opened.

Moreover, the bottom of the container is capable of being embedding into the upper surface of the cover, so that the plastic package with open reminder can be stacked up neatly for saving the storage space and avoiding the plastic package falling from the piles above.

DETAILED DESCRIPTION OF THE PREFERRED EMBODIMENTS

Figure 1:
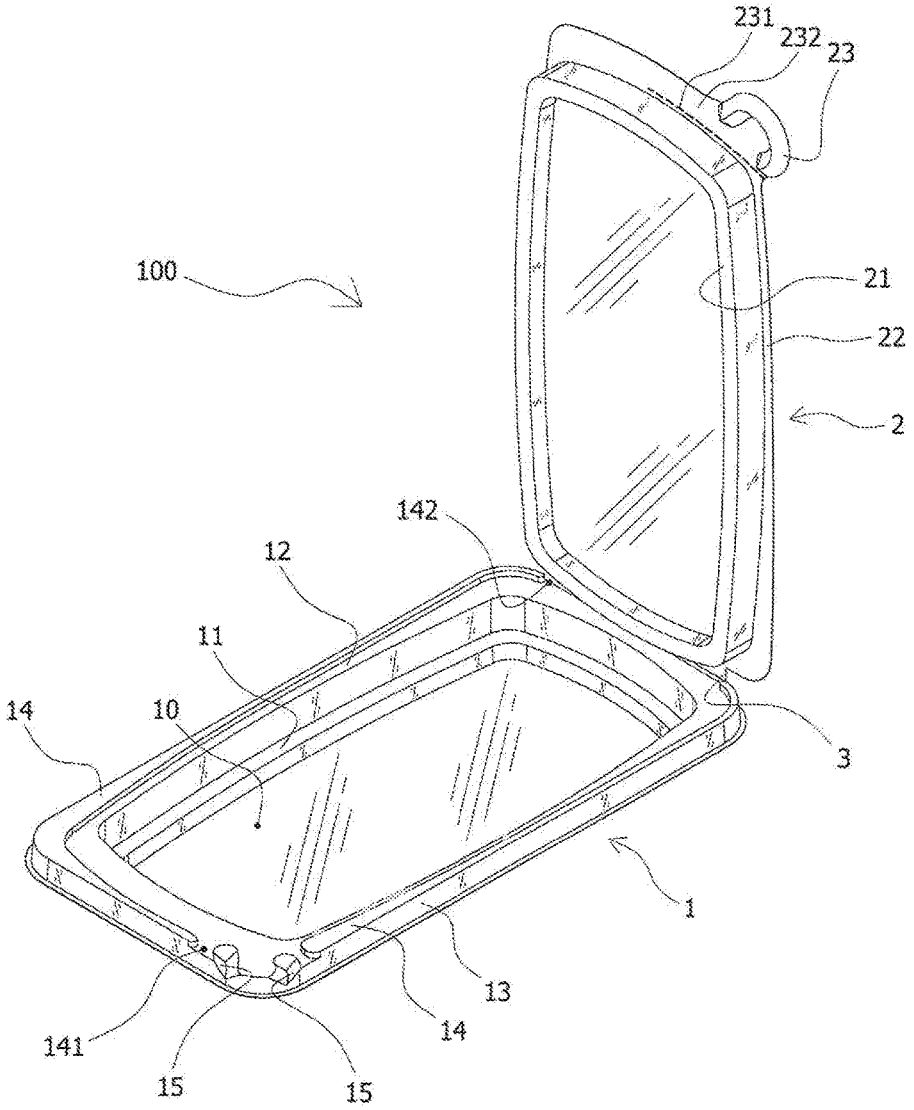
FIG. 1 is a schematic view of a first embodiment of the present invention in open status.

The following description is in accordance with the drawings:

FIGS. 1-4 and 8-11 disclose a plastic package (100) with an open reminder, comprising: a container (1), a cover (2); the container (1) comprising a containing space (10) therein, a step portion (11) formed around an inner wall thereof, a horizontal extending surface (12) formed around an outer edge of the step portion (11), an outer folding portion (13) formed around an outer edge of the horizontal extending surface (12) and extending downward therefrom, and a protruding portion (14) formed between the horizontal extending surface (12) and the outer folding portion (13), the protruding portion (14) being disposed at a position higher than the horizontal extending surface (12); the cover (2) comprising a concave portion (21) formed therearound and corresponding to the step portion (11) for securing the cover (2) in place when the cover (2) is closed, a horizontal covering body (22) extending from an outer edge of the concave portion (21), contacting to an inner wall of the protruding portion (14), and covering on the horizontal extending surface (12); the horizontal covering body (22) having at least a tab (23) sticking out from a corner of the horizontal extending surface (12); the tab (23) comprising a perforated line (231) and a pulling piece (232), the perforated line (231) extending from a point near the tab (23) to another point far away therefrom and arranged along an edge of the pulling portion; when the plastic package (100) is sealed, the container (1) is covered by the cover (2), and the concave portion (21) is embedded into the step portion (11) for combing together; when opening the cover (2), holding and pulling up the tab (23) is needed to tear off the pulling piece (232) along the perforated line (231) and then directly open the horizontal covering body (22).

The container (1) is mainly composed of the step portion (11), horizontal extending surface (12), outer folding portion (13), and the protruding portion (14). The cover (2) is mainly composed of the concave portion (21), horizontal covering body (22), and tab (23). Thus, the container (1) and the cover (2) are combined into the plastic package (100), which forms an open reminder with the tab (23) and perforated line (231), thereby achieving a function of open reminder that is easy to be observed when the cover has been opened.

Besides, due to positions between the protruding portion (14) and the horizontal covering body (22) that the protruding portion (14) is disposed at a position higher than the horizontal covering body (22), it is not easy to open the cover (2) through the horizontal extending surface (12) and the horizontal covering body (22), the only way to open the cover (2) is to tear off the perforated line (231), thus it is very easy to observe whether the plastic package (100) has been opened.

Figure 8:
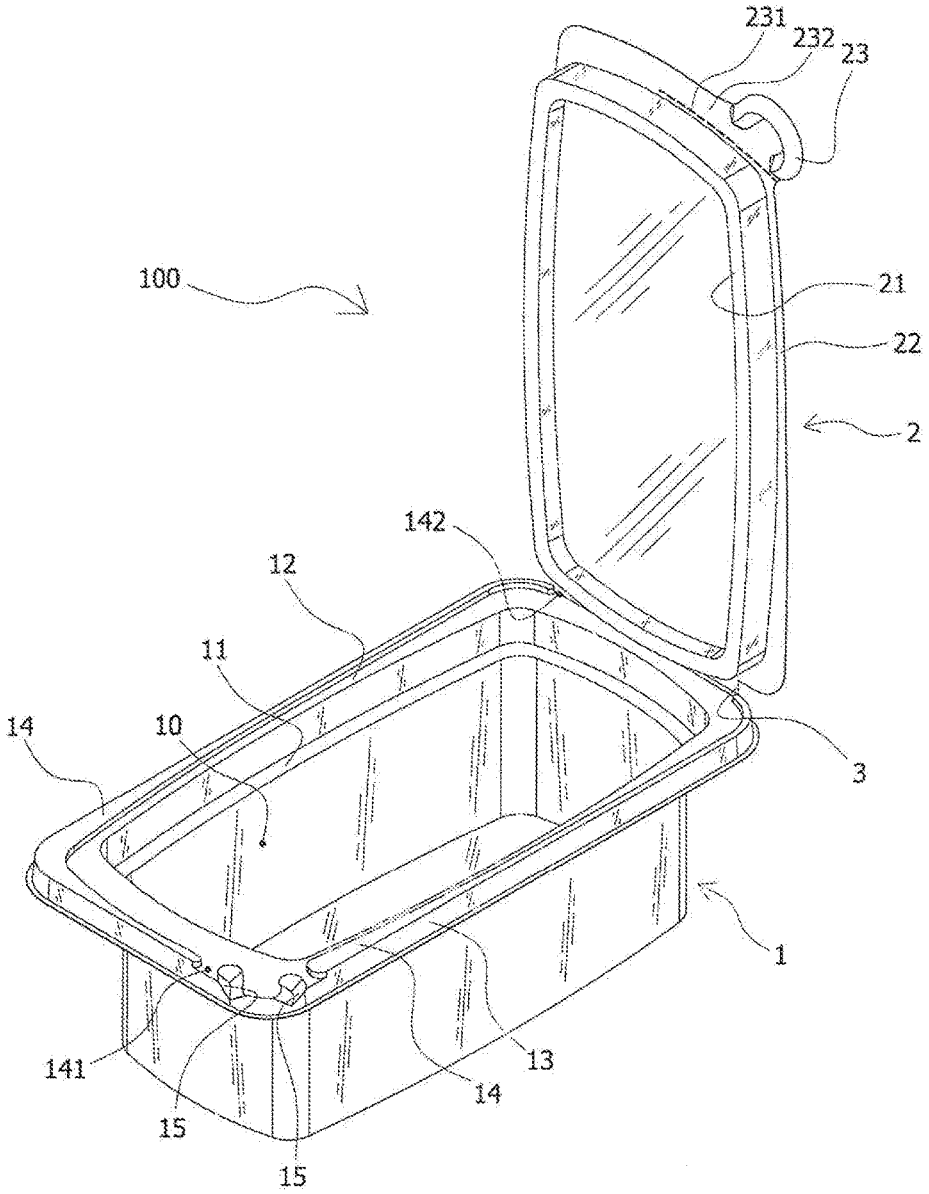
FIG. 8 is a schematic view of a second embodiment of the present invention in open status.
Figure 9:
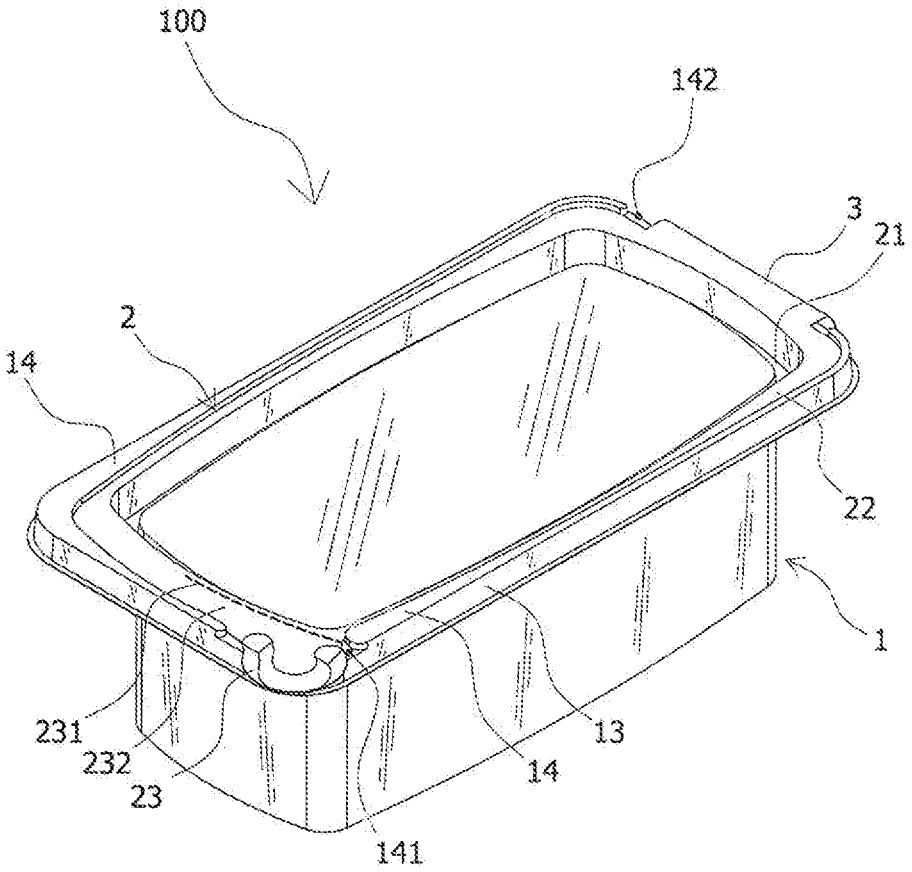
FIG. 9 is a schematic view of the second embodiment of the present invention in closed status.

Moreover, the only difference between the second embodiment and first embodiment is the container (1) as shown in FIGS. 8 and 9, so that the structure of the plastic package with open reminder is simple that can significantly decrease manufacturing time and can be produced easily in large amounts.

Figure 10:
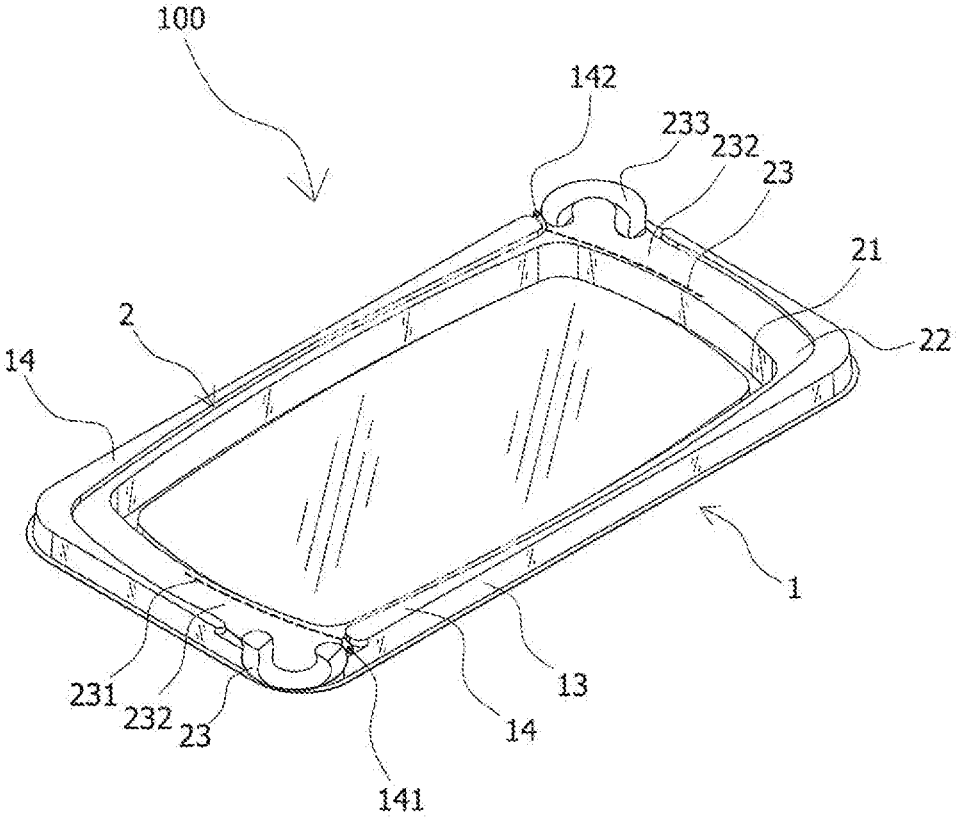
FIG. 10 is a schematic view of a third embodiment of the present invention in closed status.
Figure 11:
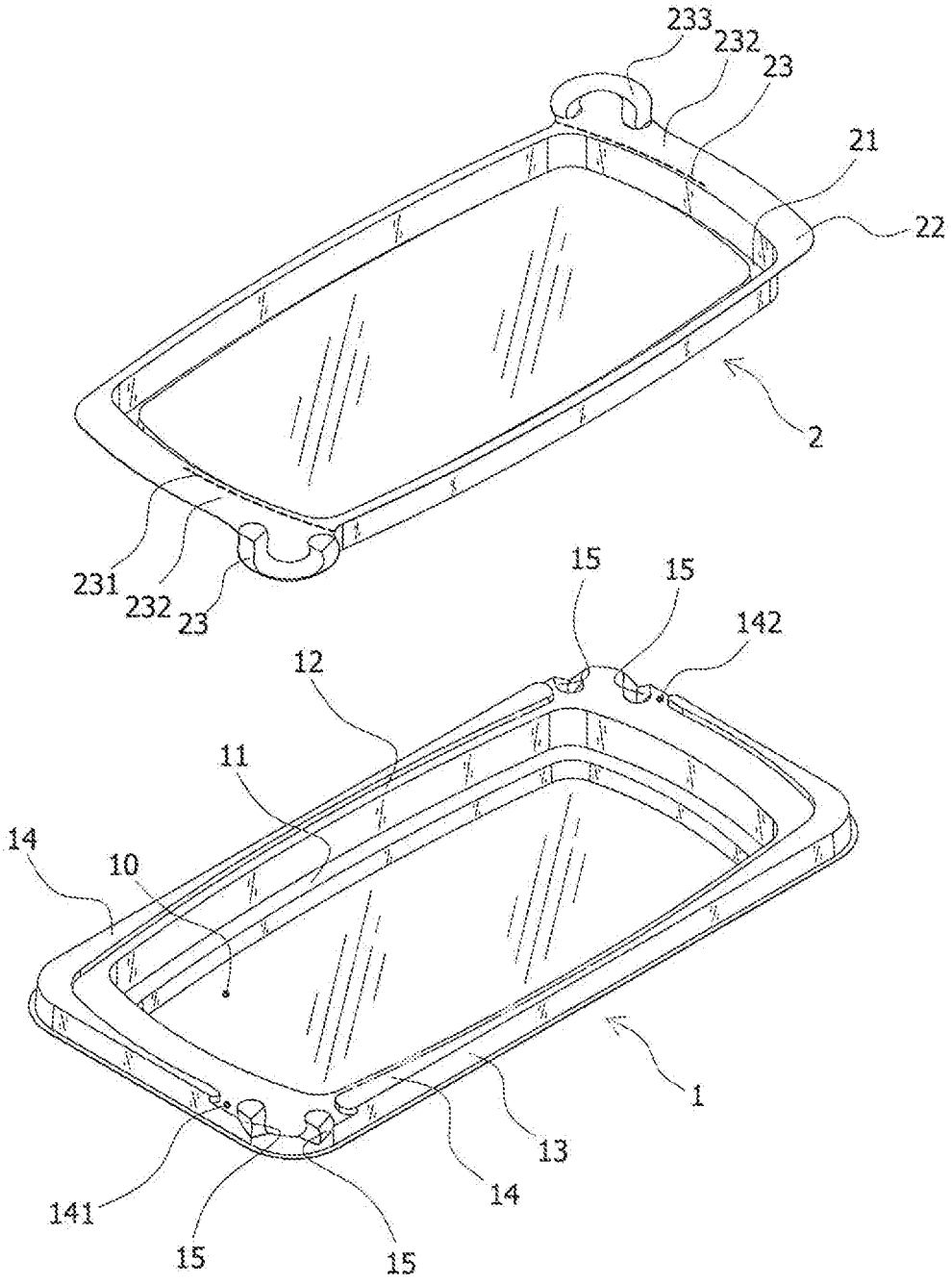
FIG. 11 is a schematic view of the third embodiment of the present invention in open status.

Furthermore, the only difference between the third embodiment and first embodiment is that the cover (2) is capable of being fully removed from the container (1) when opening the cover as shown in FIGS. 10 and 11.

Figure 5:
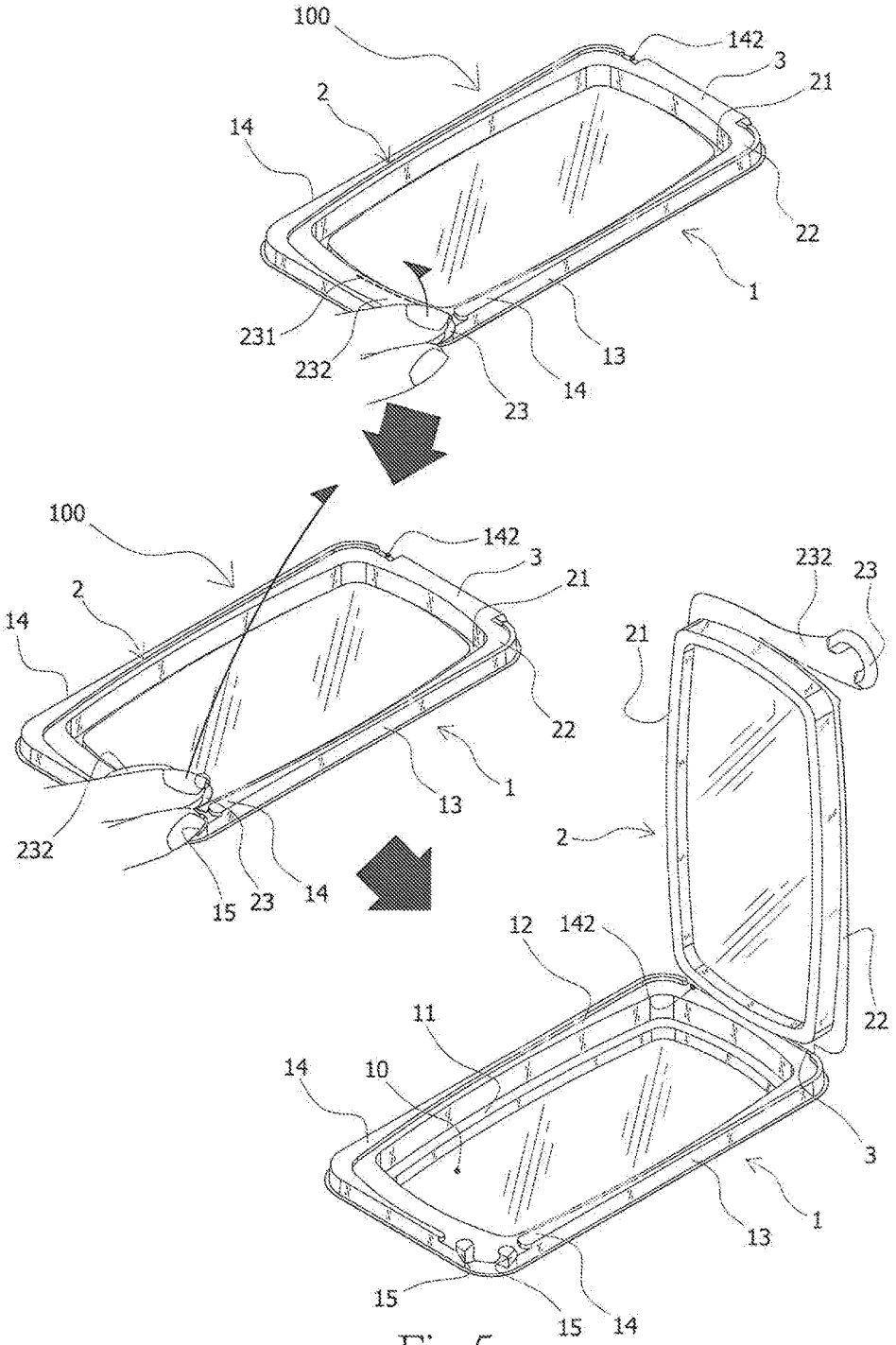
FIG. 5 illustrate opening of a cover of the first embodiment.
Figure 6:
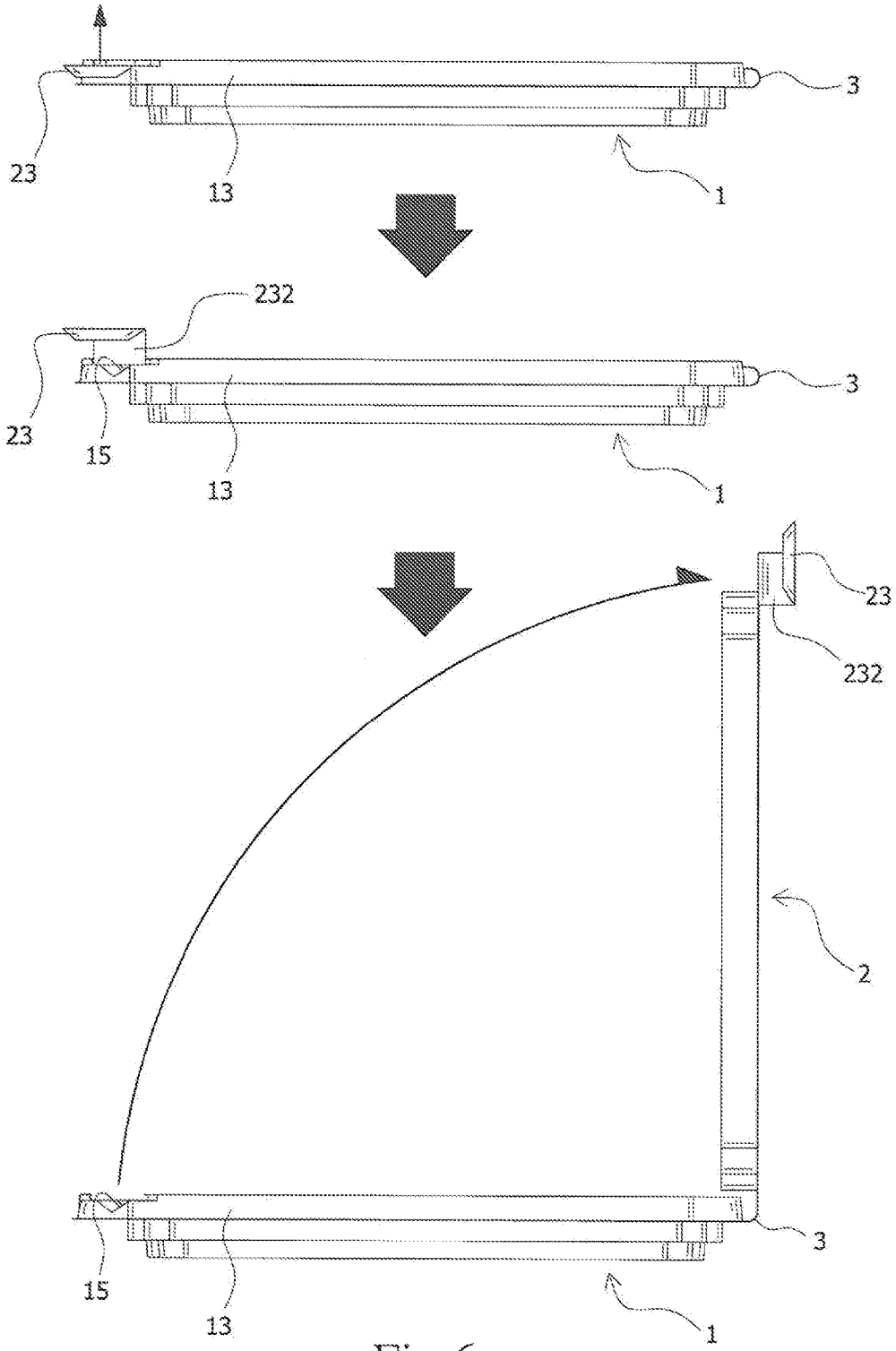
FIG. 6 illustrate opening of the cover of the first embodiment from a side view.

Referring to FIGS. 5 and 6, when the plastic package (100) is sealed, the container (1) is covered by the cover (2), and the concave portion (21) is embedded into the step portion (11) for combining together; when opening the cover (2), holding and pulling up the tab (23) is needed to tear off the pulling piece (232) along the perforated line (231), followed by the horizontal covering body (22), thereby opening the cover (2).

Figure 7:
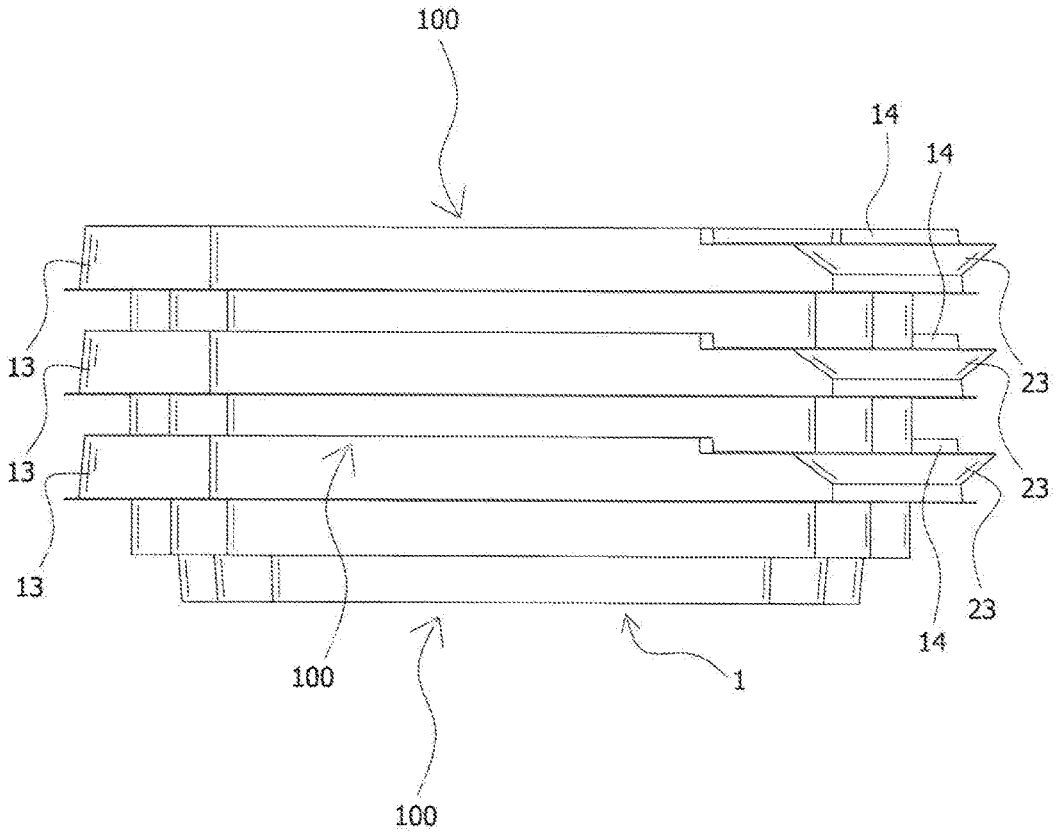
FIG. 7 illustrate a plurality of the covers being stacked up.

Referring to FIG. 7, the bottom of the container (2) is capable of being embedding into the upper surface of the cover (2), so that the plastic package with open reminder can be stacked up neatly for saving the storage space and avoiding the plastic package falling from the piles above.

Referring to FIGS. 1-2 and 8-9, wherein the horizontal covering body (22) is formed with a connecting surface (3) disposed at one side thereof to connect with a corresponding side of the horizontal extending surface (12). The connecting surface (3) can protect the cover (2) is sealed completely and prevent the cover from being undesirably opened.

Figure 2:
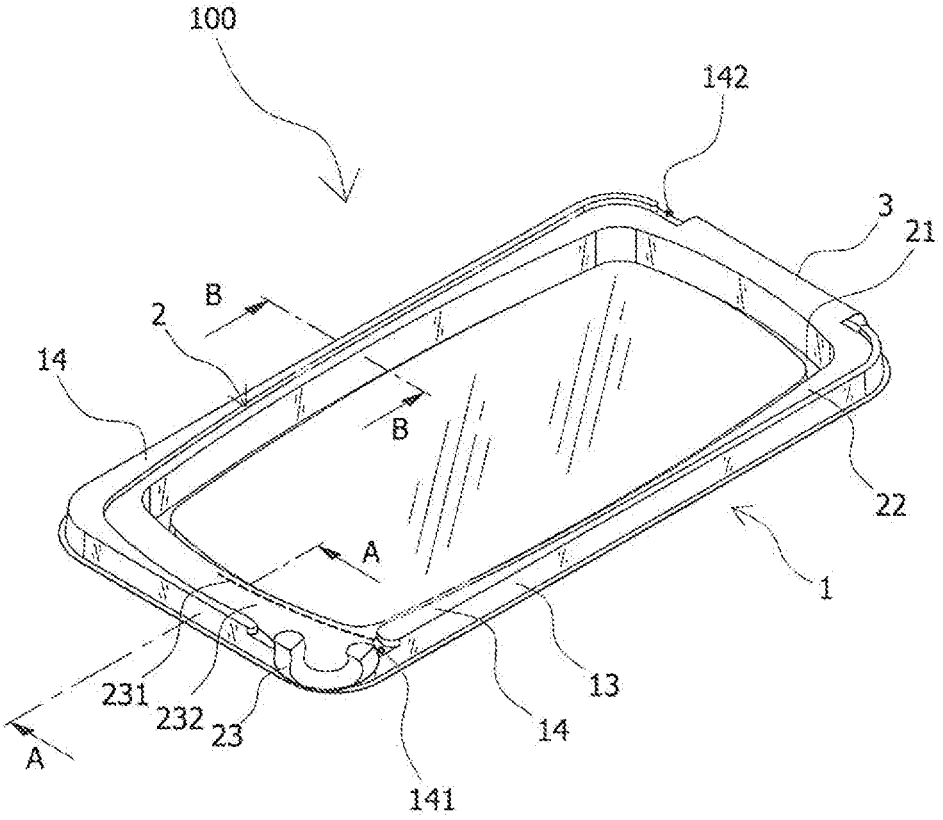
FIG. 2 is a schematic view of the first embodiment of the present invention in closed status.
Figure 3:
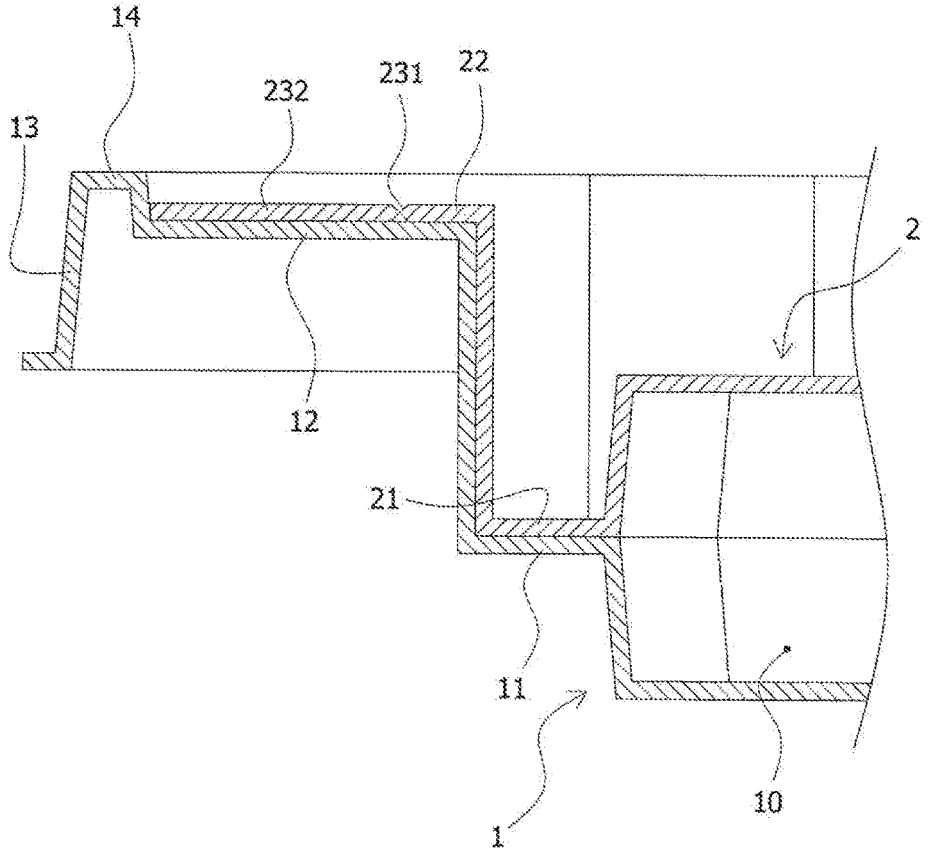
FIG. 3 is a sectional view of a section A-A in FIG. 2.
Figure 4:
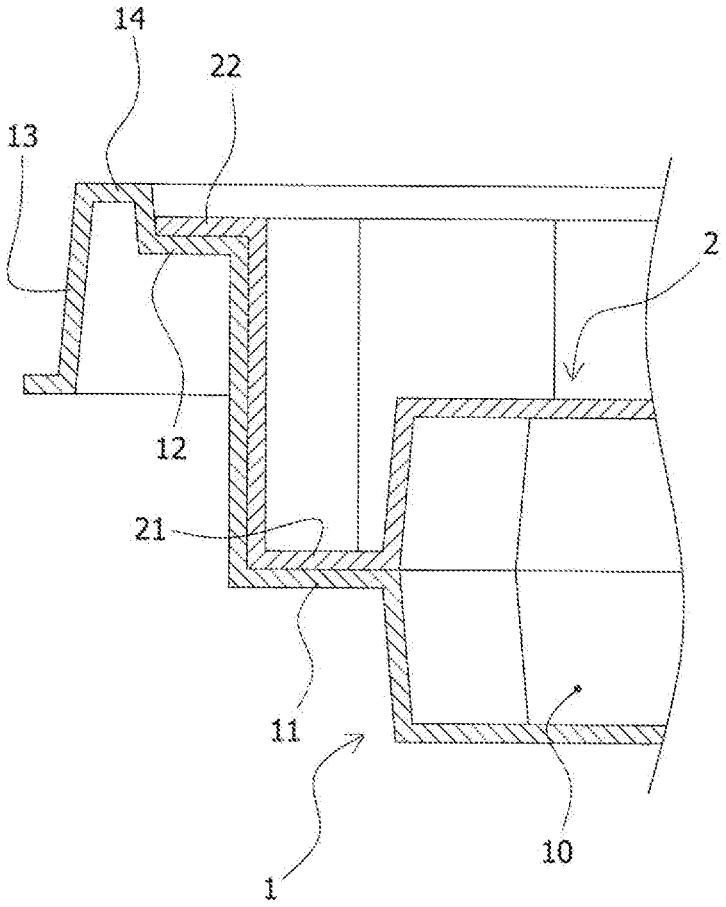
FIG. 4 is a sectional view of a section B-B in FIG. 2.

Referring to FIGS. 1 and 2, wherein the protruding portion (14) is formed with a first gap (141) corresponding to the tab (23); wherein the protruding portion (14) is formed with a second gap (142) corresponding to the connecting surface (3), so that the tab (23) is arranged more closely to the horizontal extending surface (12) to prevent the cover (2) from being opened by an external force.

Referring to FIGS. 1-2 and 8-11, wherein the horizontal extending surface (12) is formed with a recess (15) corresponding to the tab (23) for fixing the tab (23) when the cover (2) is closed.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A plastic package (100) with an open reminder, comprising:

a container (1) and a cover (2);

the container (1) comprising a containing space (10) therein, a step portion (11) formed around an inner wall thereof, a horizontal extending surface (12) formed around an outer edge of the step portion (11), an outer folding portion (13) formed around an outer edge of the horizontal extending surface (12) and extending downward therefrom, and a protruding portion (14) formed between the horizontal extending surface (12) and the outer folding portion (13), the protruding portion (14) being disposed at a position higher than the horizontal extending surface (12);

the cover (2) comprising a concave portion (21) formed therearound and corresponding to the step portion (11) for securing the cover (2) in place when the cover (2) is sealed, a horizontal covering body (22) extending from an outer edge of the concave portion (21), contacting to an inner wall of the protruding portion (14), and covering on the horizontal extending surface (12); the horizontal covering body (22) having at least a tab (23) sticking out from a corner of the horizontal extending surface (12); the tab (23) comprising a perforated line (231) and a pulling piece (232), the perforated line (231) extending from a point near the tab (23) to another point far away therefrom and arranged along an edge of the pulling portion;

when the plastic package (100) is sealed, the container (1) is covered by the cover (2), and the concave portion (21) is embedded into the step portion (11) for combining together; when opening the cover (2), holding and pulling up the tab (23) is needed to tear off the pulling piece (232) along the perforated line (231), followed by horizontal covering body (22), thereby opening the cover (2).

2. The plastic package with the open reminder according to claim 1, wherein the protruding portion (14) is formed with a first gap (141) corresponding to the tab (23).

3. The plastic package with the open reminder according to claim 1, wherein the horizontal covering body (22) is formed with a connecting surface (3) disposed at one side thereof to connect with a corresponding side of the horizontal extending surface (12).

4. The plastic package with the open reminder according to claim 1, wherein the protruding portion (14) is formed with a second gap (142) corresponding to the connecting surface (3).

5. The plastic package with the open reminder according to claim 1, wherein the horizontal extending surface (12) is formed with a recess (15) corresponding to the tab (23) for fixing the tab (23) when the cover (2) is closed.

* * * * *